US005477713A

United States Patent [19]

Lay

[11] Patent Number: 5,477,713

[45] Date of Patent: Dec. 26, 1995

[54] KEY ORIENTATION SYSTEM

[75] Inventor: Donald Lay, West Palm Beach, Fla.

[73] Assignee: Edward Roddy, III, Palm Beach, Fla.; a part interest

[21] Appl. No.: 219,637

[22] Filed: Mar. 29, 1994

[51] Int. Cl.[6] ..... E05B 15/08

[52] U.S. Cl. ..... 70/454

[58] Field of Search ..... 70/454, 423–428, 70/453, 372

[56] References Cited

U.S. PATENT DOCUMENTS

| | | | |
|---|---|---|---|
| 49,000 | 7/1865 | Pomeroy | 70/454 |
| 407,926 | 7/1889 | Folsom et al. | 70/454 |
| 516,086 | 3/1894 | Easley | 70/454 |
| 836,288 | 11/1906 | Voight | 70/427 |
| 948,446 | 2/1910 | Hausdorfer et al. | 70/454 |
| 959,965 | 5/1910 | Reffelt | 70/454 |
| 1,088,237 | 2/1914 | Mulford | 70/454 |
| 1,217,798 | 2/1917 | Mahon | 70/454 |
| 1,384,622 | 7/1921 | May | 70/454 |
| 1,389,380 | 8/1921 | Raab | 70/454 |
| 2,563,950 | 8/1951 | Martin | 70/454 |
| 2,629,057 | 2/1953 | Heinz | 70/454 |
| 2,658,151 | 11/1953 | Heinz | 70/454 |
| 2,941,392 | 6/1960 | Byrne . | |
| 2,942,452 | 6/1960 | Marchese | 70/454 |
| 2,993,362 | 7/1961 | Baccolla . | |
| 3,077,101 | 2/1963 | Jacobi . | |
| 3,537,284 | 11/1970 | Taylor . | |
| 4,295,350 | 10/1981 | Grinage | 70/454 |
| 4,549,076 | 10/1985 | Flies | 70/454 X |
| 4,638,652 | 1/1987 | Morse et al. | 70/454 |
| 4,821,542 | 4/1989 | Rosenthal | 70/454 |
| 4,875,352 | 10/1989 | Smallegan et al. | 70/454 X |
| 5,109,686 | 5/1992 | Toussant | 70/454 |

FOREIGN PATENT DOCUMENTS

| | | | |
|---|---|---|---|
| 147055 | 8/1951 | Australia | 70/454 |
| 2445880 | 9/1980 | France | 70/454 |
| 277079 | 7/1914 | Germany | 70/454 |
| 57535 | 5/1946 | Netherlands | 70/454 |
| 405856 | 2/1934 | United Kingdom | 70/454 |
| 504121 | 4/1939 | United Kingdom | 70/454 |

*Primary Examiner*—Lloyd A. Gall
*Attorney, Agent, or Firm*—Quarles & Brady

[57] ABSTRACT

A key guide for aligning an inserted key with a keyhole includes a guide body having a guide surface that spirals from an insertion opening of the guide body to the keyhole. The spiraling surface induces rotation of the inserted key until the flat blade of the key engages a stop wall extending substantially parallel from the keyhole, where alignment between the key and the keyhole is achieved.

17 Claims, 4 Drawing Sheets

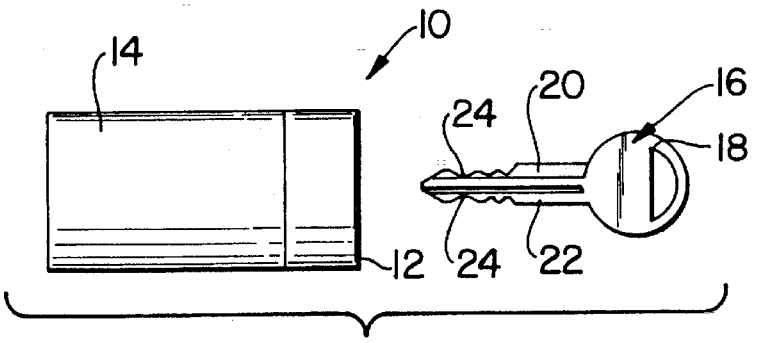
FIG. 1
FIG. 2
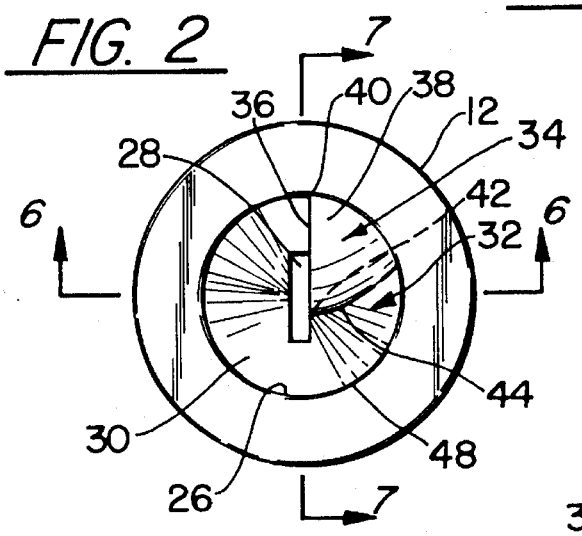
FIG. 3
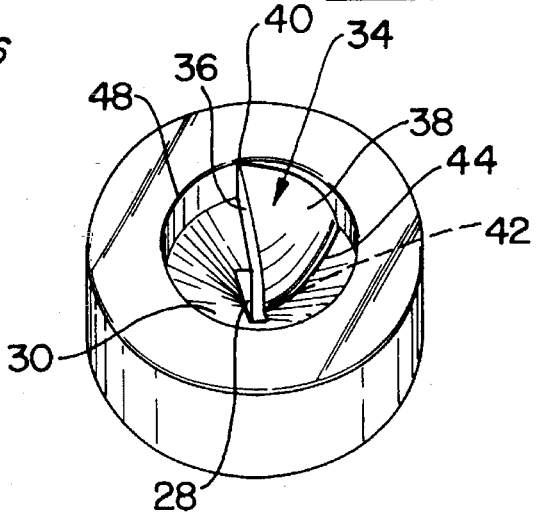
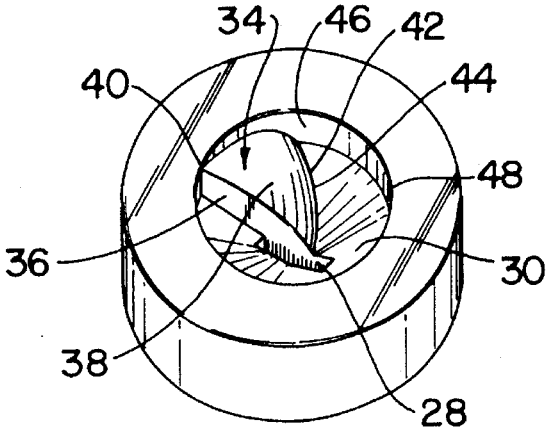
FIG. 4
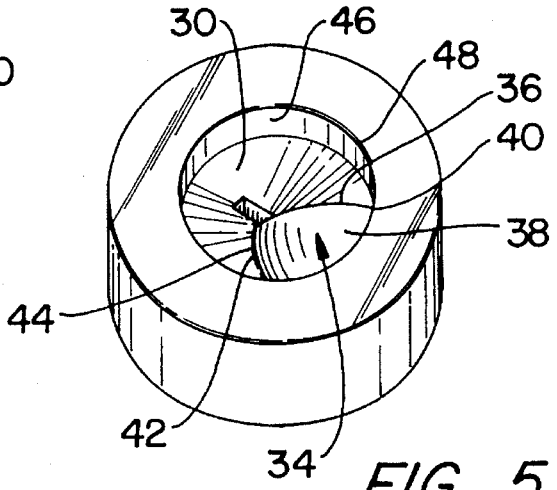
FIG. 5

KEY ORIENTATION SYSTEM

FIELD OF THE INVENTION

The invention relates to key guides for locks, particularly locks for doors of dwellings, buildings and vehicles.

BACKGROUND OF THE INVENTION

Traditional door lock faces, which have a flat surface with a reception slot for a key, have presented a challenge to users who have difficulty with aligning the key with the reception slot. The task is particularly troubling for the elderly and those with failing vision and is even a chore in unlighted areas for otherwise capable individuals.

Systems have been developed to assist in the alignment of keys with associated reception slots. For example, a key guide proposed by Baccolla in U.S. Pat. No. 2,993,362 provides a generally conical surface tapering toward the key slot to direct an inserted key toward the slot. To orient the key angularly with the slot, the conical surface has a groove along its length. However, the user must orient the key blade on the groove with much the same effort as would be required to align with the slot of the keyhole itself. A groove provided by an alternative guide of Baccolla that has inclined surfaces leading to the groove likewise requires proper angular orientation of the blade with the groove.

Grinage, in U.S. Pat. No. 4,295,350, and Rosenthal, in U.S. Pat. No. 4,821,542, also disclose guides having conical surfaces leading toward a lock keyhole, but both rely on the user for angular alignment of the key and the keyhole. U.S. Pat. No. 2,941,392 to Byrne and U.S. Pat. No. 5,109,686 to Toussant teach keyhole guides having inclined surfaces directed toward the keyhole but, again, do not alleviate an angular misalignment without user intervention. The angular rotation by the user may cause jamming in the guide structure of these prior art systems, obviating the intended assistance to be provided by these guides.

It is desirable to have a key guide that not only directs an inserted key toward the keyhole of the lock but also automatically aligns the key, when turned, angularly with the slot during the insertion process, independent of the initial angle or location of insertion into the guide.

SUMMARY OF THE INVENTION

It is an object of the invention to provide a key guide that can automatically align a key with an associated lock key slot as the key is inserted in the guide toward the slot upon rotation, independent of initial position or angle at insertion.

It is another object of the invention to provide an automatic key guide that is simple in construction and requires few parts.

It is yet another object of the invention to provide an automatic key guide that can be constructed integrally with a lock or mounted to an existing lock.

It is a further object of the invention to provide a key guide that provides key alignment in poorly lighted or unlighted environments.

It is a still further object of the invention to provide a key guide that increases speed of alignment to permit rapid entry to a locked location in emergency situations.

These and other objects of the invention are achieved by a key orientation system having a guide surface that tapers from an insertion opening toward a keyhole and a stop wall extending substantially parallel from an edge of the keyhole and connecting to the guide surface. The stop wall provides an abutment against which the flat side of a key blade can engage, as it is rotated in the guide surface, when alignment between the key and the keyhole have been achieved.

The guide surface can be constructed in a number of geometries. The guide surface can be formed by a tapering surface that is straight, such as a conical depression, or curved, such as a spherical depression. A variety of curves in between conical and spherical can also be utilized to guide an inserted key toward the keyhole.

To induce rotation of the key toward an angular alignment with the keyhole, the tapered surface can be made spiral or helical. In an embodiment that is preferred for its ease of construction, a guide terminal member that establishes the beginning and end of a guide path can be superimposed over a portion of the tapered guide surface to simulate a spiral or helical guide path. The geometry of the guide terminal member is preferably such that its surface serves both to guide an inserted key inwardly toward the keyhole in a rotational manner and also to provide the stop wall adjacent the keyhole.

The guide terminal member can have the shape of a segment of a sphere and occupy approximately a quarter of the tapering guide surface. A key that engages this guide terminal member is urged toward the tapering guide surface by the curved surface of the guide terminal member. As the key travels on its inward journey, it is induced into rotation by the spiral path formed by the union of the guide terminal member and the tapering guide surface. Upon engagement with the stop wall, further rotation is permitted only until a flat side of the key blade lies against the stop wall, at which point alignment with the keyhole occurs.

The guide terminal member alternatively can occupy approximately half of the guide surface. The semi-circular, tapering guide surface directs an inserted key toward the keyhole while the stop wall, which extends across the diameter of the semicircular area hinders further rotation when the key is aligned with the keyhole.

Thus, the key orientation system of the invention provides reliable and automatic alignment of a key and keyhole, independent of the angle or position of key insertion. The orientation system can be an integral component of the lock and enclosed within its housing. Alternatively, the system can provide its own guide body and be connected to existing locks in retrofit fashion.

BRIEF DESCRIPTION OF THE DRAWINGS

The following detailed description of embodiments of the invention is made with reference to drawings whose illustrations aid in an understanding of the invention. Among the drawings:

FIG. 1 is a side view of a lock housing equipped with a key orientation system according to an embodiment of the invention and of a conventional bladed key.

FIG. 2 is a top plan view of an embodiment of the key orientation system according to the invention;

FIG. 3 is perspective view of the key orientation system of FIG. 2;

FIG. 4 is another perspective view of the key orientation system of FIG. 3, rotated counter-clockwise slightly to further illustrate the spiral-like geometry of the guide path of the key orientation system;

FIG. 5 is still another perspective view of the key orientation system of FIG. 4, rotated counter-clockwise approximately 180 degrees to further illustrate the spiral-like geometry of the key orientation system;

DETAILED DESCRIPTION OF EMBODIMENTS OF THE INVENTION

Figure 6:
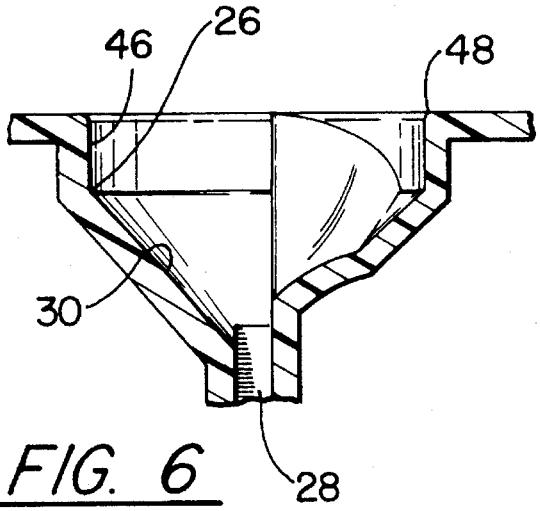
FIG. 6 is a sectional view taken along line 6—6 in FIG. 2 to show the curvature of the guide surface of the key orientation system according to FIG. 2.

The invention is directed to a key orientation system to align a key with the keyhole of a lock. The orientation system can be utilized with a variety of different locks, including automobile door locks, residential door locks, office door locks and portable locks, such as pad locks. The orientation system can be provided as part of the lock structure and encased within the same housing. Alternatively, the system can provide its own housing and be adapted to connect to existing locks in retrofit manner, and any of a variety of conventional fastening methods can be used to mount the system to an existing lock, including adhesives, hook-and-loop fasteners and snap fittings.

Referring to the figures and particularly to FIG. 1, the orientation system 10 can include a guide body 12 that is adapted to be mounted integrally to a lock 14, which can be used in an automobile, building or portable environment. The system 10 is preferably used to align a double-edged key 16 having a handle 18 and a blade 20. The blade 20 has opposing flat sides 22 and edges 24 that are cut to provide mating surfaces for an unlocking configuration of the associated lock 14.

The lock 14 includes locking structure, which is not shown. Within the scope of the invention, any locking structure which is manipulated between a locked and an unlocked position by a key can be utilized.

Referring to FIG. 2, the guide body 12 can provide an insertion opening 26 through which a key may be inserted to access the orientation system and the associated keyhole of the lock. The guide body 26 can also provide a keyhole port 28 that is aligned with a keyhole when the system 10 is mounted or otherwise secured to the face of a lock.

The guide body 12 provides a guide surface 30 that extends from the insertion opening 26 to the keyhole port 28. The guide surface 30 is preferably circular and tapers radially toward the keyhole port 28. The guide path terminates at a stop wall 36, which serves to stop the rotation of an inserted key when the flat side 22 (see FIG. 1) of the key engages the stop 36, signifying an alignment between the key and the keyhole port 28.

The guide body 12 provides a spiral or helical-like guide path 32 from the insertion opening to the keyhole port. Within the context of the invention, a spiral or helical-like surface refers to a surface that extends along a central axis from the insertion opening 26 to the keyhole port 28 in a coil or cyclical path. Due to the tapered geometry of the guide surface 30, the path 32 also advances toward the central axis as it advances toward the keyhole port 28.

The spiral or helical path 32 can be obtained in a number of ways. The guide body 12 can be molded to form a unitary guide path. Alternatively, the tapering guide surface 30 can be formed and a guide terminal member 34 can be attached, such as by adhesives, to provide a stop wall 36 and a terminal surface 38.

Referring to FIGS. 3–5 in connection with FIG. 2, the guide path 32 can be formed by the terminal member 34 superimposed on the tapering guide surface 30. The terminal member 34 can extend circumferentially from approximately the twelve o'clock position 40 to approximately the two-thirty or three o'clock position 42. The surface 38 of the terminal member 34 is preferably a curved surface extending from the insertion opening 26 to a junction 44 with the guide surface 30 and can be defined as a segment of a spherical surface.

The terminal member 34 also provides the stop wall 36, which extends from the keyhole port 28 toward the insertion opening 26. The stop wall 36 can extend completely to the insertion opening 26 or can end prior to the insertion opening 26, provided a sufficient abutment surface exists to engage and stop a rotated key blade.

The guide body 12 can provide a rim 46 from an initial opening 48 in the guide body 12 to the insertion opening 26. The guide path 32 can begin at any point along this rim 46 or can begin at the insertion opening 26.

Figure 7:
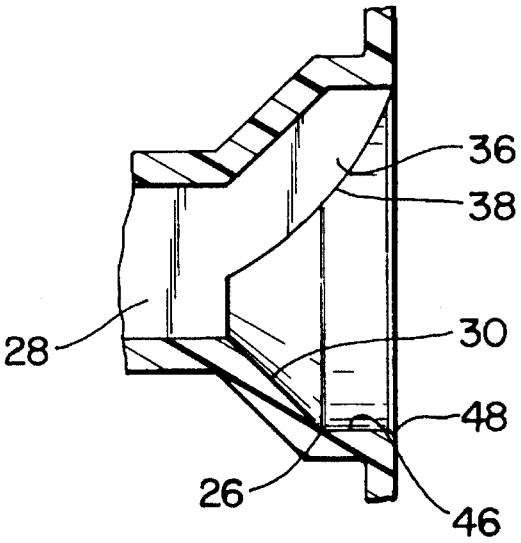
FIG. 7 is a sectional view taken along line 7—7 in FIG. 2 to show the curvature of the guide surface of the key orientation system according to FIG. 2 along its stop wall.
Figure 8:
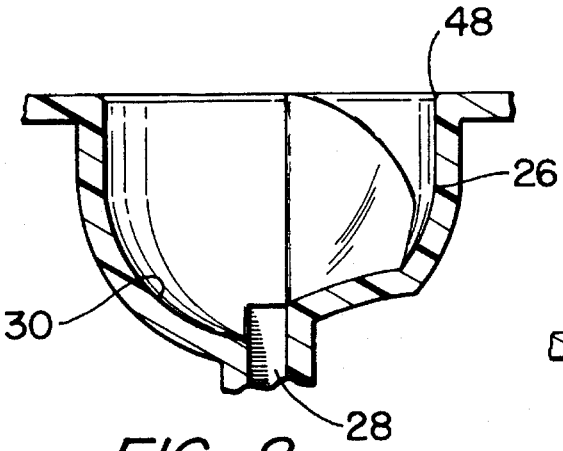
FIG. 8 is a sectional view of an alternative guide surface geometry for the key orientation system.
Figure 9:
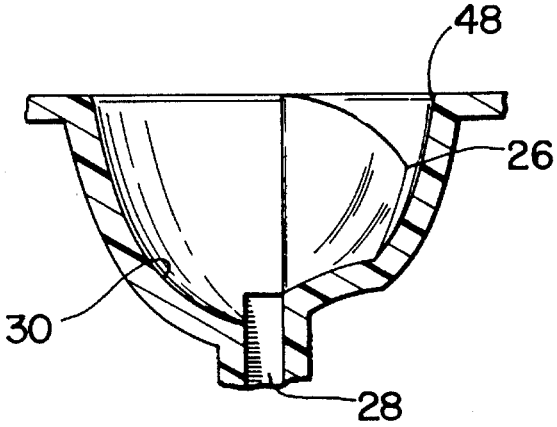
FIG. 9 is another sectional view of an alternative guide surface geometry for the key orientation system.

Referring to FIGS. 6–9, the tapering guide surface 30 can have. different geometries in cross-section. As shown in FIGS. 6 and 7, the tapering surface 30 can be straight, thereby forming a conical depression toward the keyhole port 28. Alternatively, as shown in FIG. 8, the tapering surface 30 can correspond to a spherical depression. Any of the curves in the family of curves between a straight line and a circular curve can be utilized according to the invention. As shown in FIG. 9, the surface 30 can follow an elliptical curve.

Figure 10:
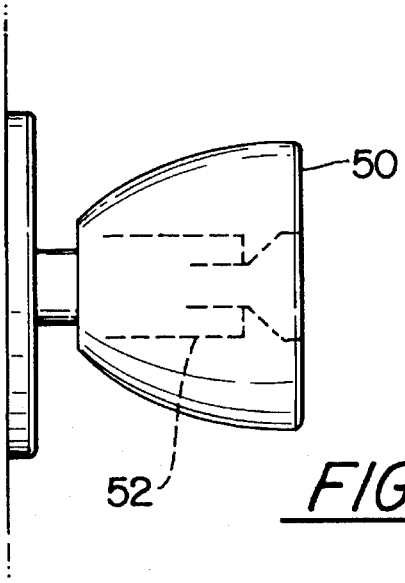
FIG. 10 is a side view of a door lock, showing a preferred location of an integrated version of the key orientation system.

The orientation system can be provided in its own body or housing or can be constructed as an integral part of a lock. Referring to FIG. 10, the orientation system can, for example, be incorporated into the knob 50 of a keyed door lock 52.

Figure 11:
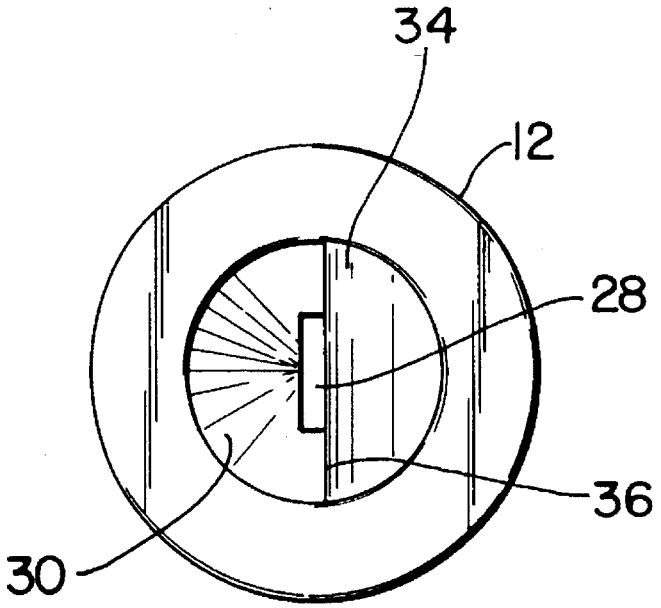
FIG. 11 is a top plan view of an alternative embodiment of the key orientation system.
Figure 12:
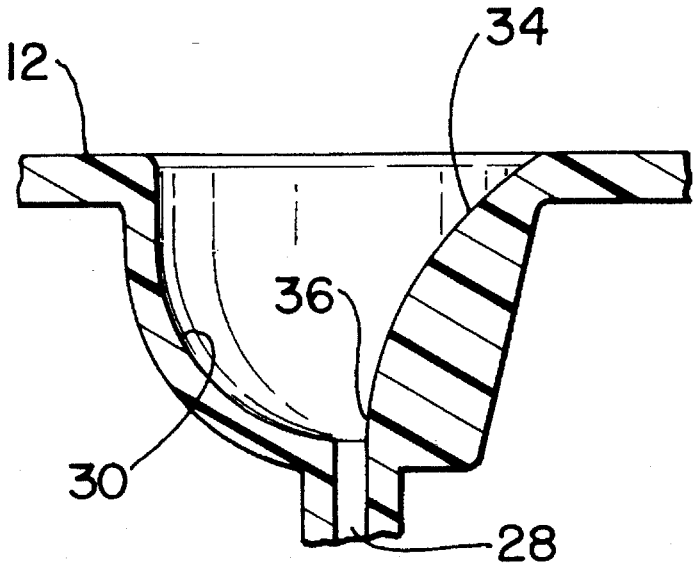
FIG. 12 is a sectional view of an alternative key orientation system.

Referring to FIG. 11, the guide surface 30 can be semicircular with a tapering surface toward the keyhole port 28. The guide body 12 can be formed or a terminal member 34 can be added to define a stop wall 36 that extends substantially along the diameter of the semicircular area. The stop wall 36 can extend substantially vertically from the keyhole to the opening of the guide body 12. As shown in FIG. 12, the terminal member 34 can alternatively curve from the opening of the guide body 12 to a substantially vertical stop wall 36 which extends from the keyhole port 28, but terminates before the opening of the guide body 12. An inserted key is guided toward the keyhole port 28 and stopped from further rotation by the stop wall 36 when alignment of the key blade and the keyhole port is achieved.

Figure 13:
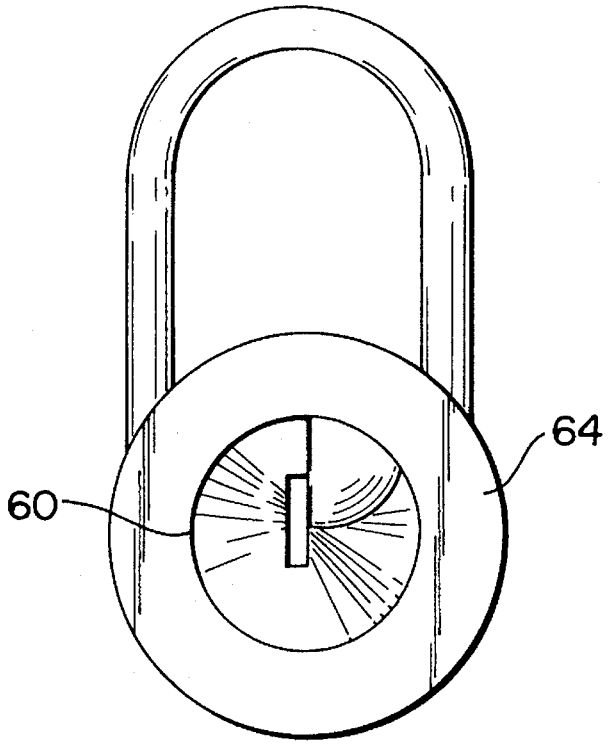
FIG. 13 is a side elevation of a key orientation system as used in an automobile lock.
Figure 14:
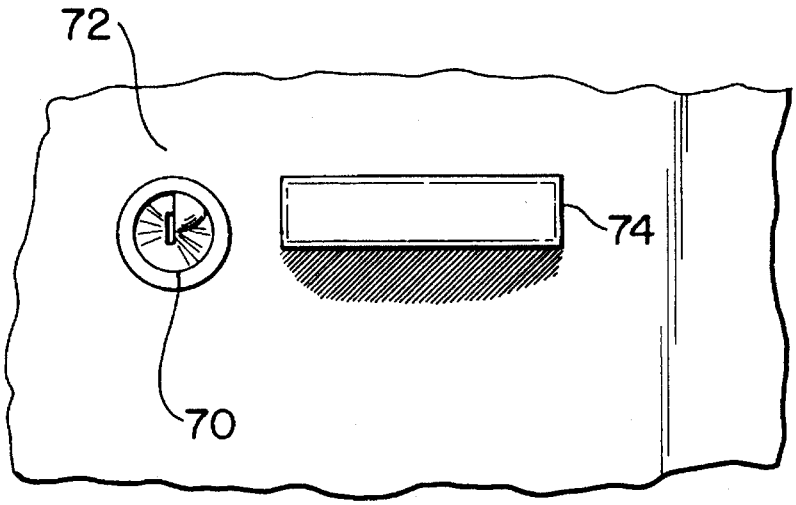
FIG. 14 is a side elevation of a key orientation system according to the invention as used in an portable padlock.

The invention is useful on many types of locks. In FIG. 13, a lock 60 is shown as part of a padlock 64, which can otherwise be of conventional construction. In FIG. 14, a lock 70 according to the invention is shown as installed in an automobile door 72, such as adjacent to a handle 74.

Thus, the invention provides a key orientation system that combines a tapering guide surface and a stop wall to automatically direct an inserted key toward a keyhole and stop rotation of the inserted key when angular alignment of the key and keyhole are achieved, independent of the angle and position of initial insertion into the system.

Although the description of this invention has been given with reference to particular embodiments, this description is not to be construed as limiting the scope of this invention. Many variations and modifications can now occur to those skilled in the art in view of this disclosure. Accordingly, the scope of the present invention should not be determined by the above description, but rather by a reasonable interpretation of the appended claims.

I claim:

1. A key orientation system for aligning a key with a keyhole of a lock, said system comprising:

a guide body having an insertion opening and a guide surface extending from said insertion opening to an elongated keyhole port, said keyhole port being alignable with a keyhole of a lock, said guide surface providing a three dimensional spiraling path from said insertion opening to said keyhole port, said guide body providing a stop wall in addition to said spiral path having an abutment surface substantially parallel to an elongated edge of the keyhole port, whereby a key having a flat blade can be rotated along said spiral path until engagement of a flat side of the key with said stop wall and alignment with said keyhole port is achieved.

2. The system according to claim 1, wherein said stop wall extends substantially to said insertion opening.

3. The system according to claim 1, wherein said guide body has an initial opening and provides a rim from said initial opening to said insertion opening.

4. A key orientation system for aligning a key with a keyhole of a lock, said system comprising:

a guide body having an insertion opening and a guide surface extending from said insertion opening to an elongated keyhole port, said insertion opening and said keyhole port being in different planes, said port having an elongated edge and an adjacent narrower edge, said keyhole port being alignable with a keyhole of a lock, said guide surface tapering from said insertion opening towards said keyhole port, said guide body providing a stop wall extending from an edge of said keyhole port toward said insertion opening, said stop wall providing an elongated abutment surface substantially parallel to an elongated edge of the keyhole port, whereby a key having a flat blade can be rotated along said guide surface until engagement of a flat side of the key with said stop wall and alignment with said keyhole port is achieved.

5. The system according to claim 4, wherein said guide surface is substantially circular.

6. The system according to claim 5, wherein said guide body further provides a terminal surface extending substantially from said insertion opening to a junction with said tapering guide surface, said terminal surface spanning approximately one quarter of said circular guide surface, said terminal surface providing an edge of said stop wall.

7. The system according to claim 6, wherein said terminal surface is defined by a segment of a sphere.

8. The system according to claim 5, wherein the tapering guide surface is at least partially a conical depression.

9. The system according to claim 5, wherein the tapering guide surface is at least partially a spherical depression.

10. The system according to claim 5, wherein the tapering guide surface is a curved depression.

11. The system according to claim 5, wherein a terminal member is integrally connected to said guide surface, said terminal member providing a terminal surface extending substantially from said insertion opening to a junction with said tapering guide surface, said terminal surface spanning approximately one quarter of said circular guide surface, said terminal surface providing an edge of said stop wall.

12. The system according to claim 4, wherein said guide surface in plan view is substantially semicircular and said stop wall extends substantially across a diameter of said semicircular plan view of said guide surface.

13. The system according to claim 4, wherein said guide surface in plan view is essentially semicircular and said stop wall extends across a diameter of said semicircular plan view of said guide surface, and a curvilinear terminal surface extending from said insertion opening to said stop wall.

14. A lock, comprising:

locking structure;

a housing defining a keyhole for receiving a key to engage said locking structure; said keyhole having an elongated edge and an adjacent narrower edge; and key orientation system for aligning a key with the keyhole, said system including:

a guide body having an insertion opening and a guide surface extending from said insertion opening to said keyhole, said guide surface tapering from insertion opening toward said keyhole, said guide body providing a stop wall extending from an edge of said keyhole toward said insertion opening, said stop wall providing an abutment surface substantially parallel to an elongated edge of the keyhole, whereby a key having a flat blade can be rotated along said guide surface until engagement of a flat side of the key with said stop wall and alignment with said keyhole is achieved.

15. The lock according to claim 14, wherein the lock is an automobile door lock.

16. The lock according to claim 14, wherein the lock is a building door lock.

17. The lock according to claim 14, wherein the lock is a portable padlock.

* * * * *